US007335079B1

(12) United States Patent
Darling

(10) Patent No.: US 7,335,079 B1
(45) Date of Patent: Feb. 26, 2008

(54) MULTIPURPOSE FLOTATION DEVICE

(76) Inventor: Gregory D. Darling, 209 N. Center, Toledo, IA (US) 52342

( * ) Notice: Subject to any disclaimer, the term of this patent is extended or adjusted under 35 U.S.C. 154(b) by 0 days.

(21) Appl. No.: 11/581,301

(22) Filed: Oct. 16, 2006

Related U.S. Application Data

(60) Provisional application No. 60/750,129, filed on Dec. 15, 2005.

(51) Int. Cl.
*B63C 9/08* (2006.01)

(52) U.S. Cl. ..... 441/129; 441/130

(58) Field of Classification Search ..... 441/127, 441/129, 130, 132
See application file for complete search history.

(56) References Cited

U.S. PATENT DOCUMENTS 4,394,783 A * 7/1983 Simmons ..... 297/230.1
5,324,221 A * 6/1994 Kaufman et al. ..... 441/129
5,411,425 A * 5/1995 Rinker ..... 441/130
5,779,513 A * 7/1998 Burton et al. ..... 441/129
6,062,930 A * 5/2000 Smith ..... 441/129
D541,366 S * 4/2007 Rominger ..... D21/803

* cited by examiner

*Primary Examiner*—Stephen Avila

(57) ABSTRACT

A multipurpose throwable personal flotation device includes a pair of flat buoyant panels pivotally connected at inward ends to a central buoyant panel with parallel hinges. Each of the panels is enclosed in a fabric cover, with lines of stitching connecting layers of the cover between the panels forming the hinges. A strap is affixed along the upper faces of the panels, with two loops projecting beyond the ends of the panels to form handles for throwing the device.

14 Claims, 2 Drawing Sheets

MULTIPURPOSE FLOTATION DEVICE

CROSS-REFERENCES TO RELATED APPLICATIONS

This application claims the benefit of U.S. Provisional Application Ser. No. 60/750,129 filed Dec. 15, 2005.

STATEMENT AS TO RIGHTS TO INVENTIONS MADE UNDER FEDERALLY SPONSORED RESEARCH AND DEVELOPMENT (Not Applicable)

INCORPORATION-BY-REFERENCE OF MATERIAL SUBMITTED ON A COMPACT DISC (Not applicable)

BACKGROUND OF THE INVENTION (1) Field of the Invention

The present invention relates generally to personal flotation devices (PFD's), and more particularly to an improved throwable PFD with multiple uses.

(2) Description of Related Art Including Information Disclosed Under 37 CFR 1.97, 1.98

Personal Flotation Devices (PFD) are manufactured in five types (Type I, II, III, IV, and Type V). Types I, II, III, and V are wearable devices, and Type IV is a throwable device. According to Federal Requirements, all recreational boats must carry one wearable PFD for each person aboard. Any boat 16 feet or longer (except canoes and kayaks) must also carry one throwable PFD.

In general, there are three basic kinds of PFD's—those that are inherently buoyant, those that are inflatable, and those that are a hybrid of the two. Wearable PFD's are manufactured in all three of these kinds. The invention herein relates to Type IV throwable PFD's. Throwable PFD's are only manufactured in the "Inherently Buoyant" variety. While there are inflatable and hybrid devices on the market, they are not approved as Personal Flotation Devices, and therefore are not relevant to the discussions herein.

Federal United States Coast Guard (USCG) Requirements require that throwable PFD's have certain minimum buoyancy characteristics. A throwable cushion must have a minimum buoyancy of 20 lb. while a throwable ring buoy must either have a minimum buoyancy of 16.5 lb. (child) or 32 lb. (adult).

The throwable ring buoys presently used as a throwable PFD are rigid foam rings that can be used only for purposes as a PFD. On the other hand, throwable cushions typically have more uses than ring buoys. Prior art throwable cushions are conventionally formed of a rectangular sheet of closed cell foam and covered with a cloth material. Two handles are attached on opposite edges of the cushion and are typically formed from a strap sewn to the cushion, so that the cushion may be thrown to persons in the water.

While prior art throwable cushions can be used as a seat cushion or back cushion in addition to the primary purpose as a PFD, the inventor herein has found that the typical rectangular or square shape of such cushions is unnecessarily restrictive.

BRIEF SUMMARY OF THE INVENTION

It is therefore a general object of the present invention to provide an improved multipurpose throwable PFD.

A further object is to provide a multipurpose throwable PFD that be folded into a U-shape.

Yet another object of the present invention is to provide a multipurpose throwable PFD that can be used to simultaneously cushion both the back and seat of an individual.

Yet a further object is to provide a multipurpose throwable PFD that is inexpensive to manufacture, simple to use, and refined in appearance.

These and other objects will be apparent to those skilled in the art.

The multipurpose throwable PFD of the present invention includes a pair of flat buoyant panels pivotally connected at inward ends to a central buoyant panel with parallel hinges. Each of the panels is enclosed in a fabric cover, with lines of stitching connecting layers of the cover between the panels forming the hinges. A strap is affixed along the upper faces of the panels, with two loops projecting beyond the ends of the panels to form handles for throwing the device.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
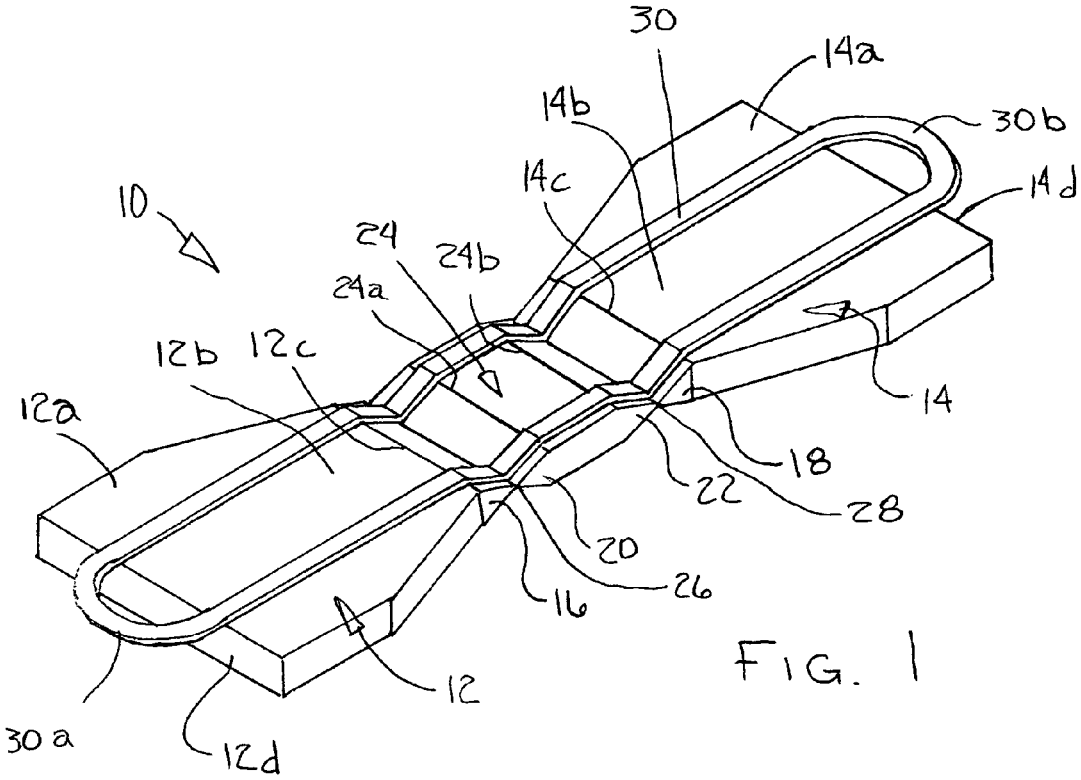
FIG. 1 is a perspective view of the multipurpose PFD of the present invention.
Figure 2:
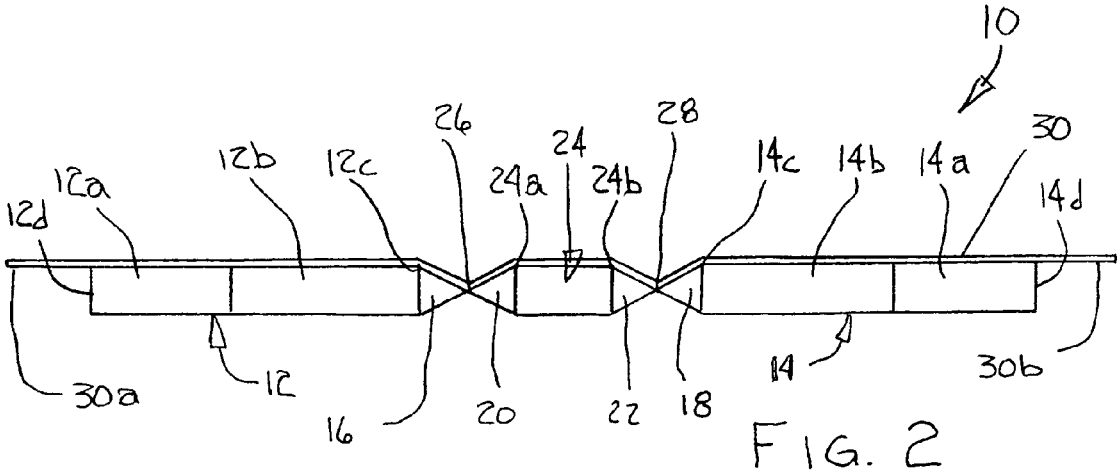
FIG. 2 is a side elevational view of the PFD of FIG. 1.

Referring now to the drawings, and more particularly to FIGS. 1 and 2, the multipurpose Personal Flotation Device (PFD) of the present invention is designated generally at 10, and includes a pair of primary, buoyant panels 12 and 14 connected at inward ends to a central buoyant panel 16. Panels 12, 14 and 24 are each constructed of a closed cell foam material completely enclosed within a fabric cover, such as nylon or the like.

In the preferred embodiment of the invention, panels 12, 14 and 24 are each about 2 inches in thickness. Primary panels 12 and 14 are identical in shape and size, and have a rectangular base portion 12*a* and 14*a*, and a trapezoidal inward portion 12*b* and 14*b*, in plan view. The narrowed inward ends 12*c* and 14*c* of the trapezoids are beveled to form wedges 16 and 18 respectively. The apexes of wedges 16 and 18 are pivotally connected to the apexes of wedges 20 and 22, respectively, formed on the outward ends 24*a* and 24*b*, respectively, of central panel 24. It can therefore be seen that the connections of the primary panel wedges 16 and 18 with the central panel wedges 20 and 22 form flexible, bendable fabric hinges 26 and 28, respectively.

As noted above, primary panels 12 and 14 have generally rectangular base portions 12*a* and 14*a* with the outward edges 12*d* and 14*d*, respectively. The width of central panel 24 is preferably equal to the narrowed width of the inward edges 12*c* and 14*c* of primary panels 12 and 14, which is narrower than the width of the base portions 12*a* and 14*a*.

A strap handle 30 is affixed to the upper faces of the panels 12, 14 and 24, with opposing loops 30*a* and 30*b* projecting outwardly beyond the outward edges 12*d* and 14*d* of primary panels 12 and 14. Strap handle 30 is a very strong flexible synthetic strap such as nylon or the like. Preferably, strap 30 will be continuously attached by stitching or the like directly to each of the upper faces of panels 12, 14, and 30 as well as the sloped upper surfaces of wedges 16, 18, 20 and 22, so that there are no loose or projecting portions other than projecting loops 30*a* and 30*b*.

Because the multipurpose flotation device 10 of the present invention is formed from panels of a buoyant high-impact closed cell foam material of sufficient buoyancy, and is provided with throw handles 30*a* and 30*b*, the main function of device 10 is to serve as a Class IV throwable Personal Flotation Device. However, the unique design of device 10 also makes the device capable of many other uses, previously unknown for such devices.

Figure 3:
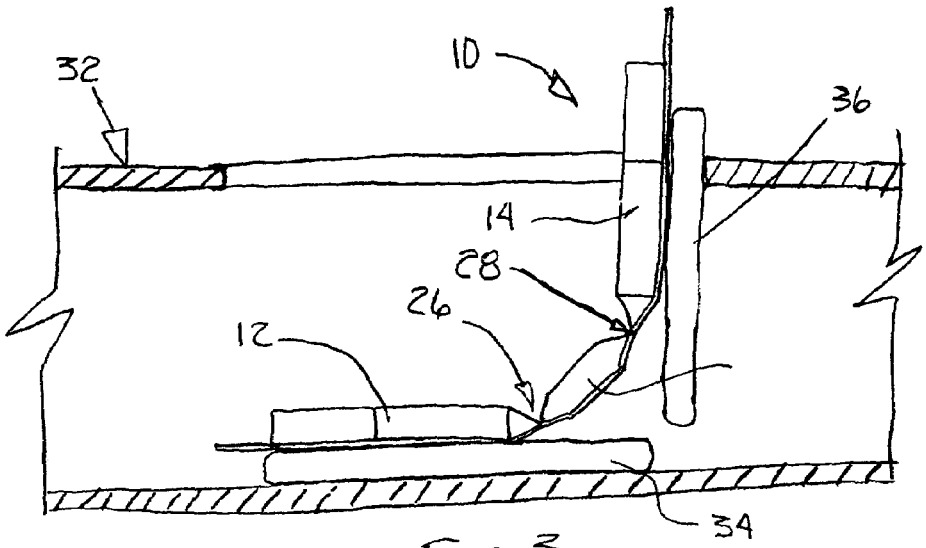
FIG. 3 is a vertical sectional view through a kayak showing the PFD oriented for use as a seat and backing cushion.

Referring now to FIG. 3, a second purpose for flotation device 10 is for use as a seat and back cushion. Because of the hinges 26 and 28, the device 10 may be bent completely over on top of itself (not shown), or into a 90° orientation such as that shown in this drawing. In this case, device 10 is shown inserted in a kayak 32, with panel 12 resting on the bottom seat 34 of the kayak 32 and panel 14 resting against the back 36 of kayak 32. While device 10 is shown with central panel 24 oriented at a 45° angle, it should be noted that hinges 26 and 28 will each permit movement to at least a 90° angle, thereby allowing central panel 24 to be used for extra length on seat 34 or against back 36, as needed.

Figure 4:
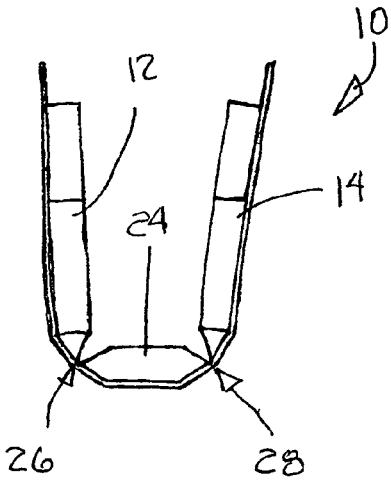
FIG. 4 is a side elevational view showing the PFD oriented for use as a body support in the water.

Referring now to FIG. 4, a third purpose for flotation device 10 is for use as a buoyant support in the water. The U-shaped configuration of device 10 is permitted by virtue of the nearly 90° angles at which hinges 26 and 28 are oriented. A person can then straddle central panel 24 with the legs, positioning panel 12 in front and panel 14 in back, so as to support them in the water. The narrower width of central panel 24 assists in providing a more comfortable fit for a person when using device 10 in this manner.

Figure 5:
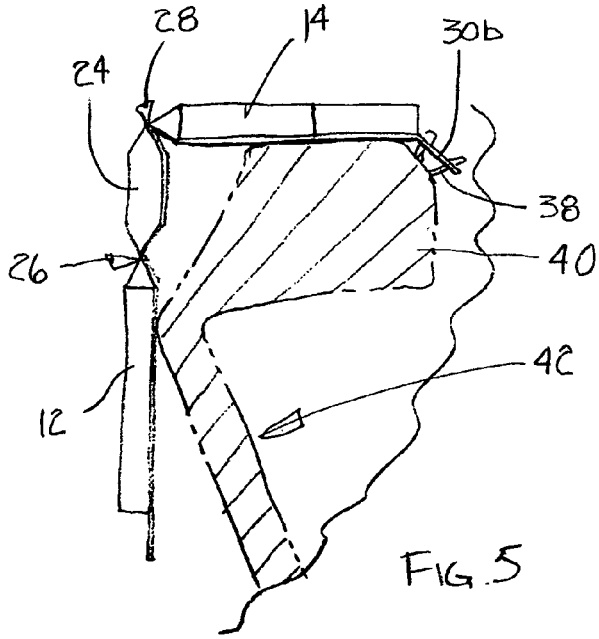
FIG. 5 is a vertical sectional view through a portion of a boat showing the PFD oriented for use as a boat cushion.

Referring now to FIG. 5, a fourth purpose for flotation device 10 is for use as an impact cushion between boats. One handle loop 30*b* may be connected to a hook 38 or the like on the side rail 40 of a boat 42. Panel 14 will extend over the top of the side rail of boat 42, and panels 12 and 24 will then extend downwardly alongside the boat 42 to form a pad or cushion against impacts with a dock or other objects. Again, hinges 26 and 28 permit this generally inverted L-shape of device 10.

An additional orientation of device 10 is shown in FIG. 1, where device 10 is laid flat. The device 10 can then either be used as a cushion on solid ground, or as a flotation device for swimming or floating in the water. While existing prior art throw cushions (whether square or ring-shape) could also be used in this manner, the overall elongated rectangular shape of device 10 makes the multipurpose flotation device 10 a more desirable cushion for such uses. The device 10 can either be oriented along the length of the body, or turned transversely, to follow the curvature of the torso and form "wings."

Whereas the invention has been shown and described in connection with the preferred embodiments thereof, many modifications, substitutions and additions may be made which are within the intended broad scope of the appended claims.

What is claimed is:

1. A multipurpose flotation device, comprising:

a first flat buoyant panel having inward and outward ends, a width between side edges, and upper and lower faces;

a second flat buoyant panel having inward and outward ends, a width between side edges, and upper and lower faces;

said first and second panels pivotally connected together at their inward ends along a transverse hinge, for pivotal movement of the first and second panels from a substantially flat, coplanar configuration to a substantially U-shaped configuration;

said first and second panels having a uniform thickness, the thickness of each of the first and second panels along their inward ends being beveled to form a wedge, the apexes of the wedges connected at said pivotal hinge connection;

said first and second panels being identical in shape and size; and wherein each of said first and second panels has a trapezoidal inward portion and a rectangular base portion in plan view, with a narrowed width of the trapezoid forming the inward end of the first and second panels.

2. The flotation device of claim 1, further comprising a strap mounted on the upper faces of said first and second panels with a loop forming a handle projecting beyond the outward ends of the first and second panels.

3. The flotation device of claim 2, wherein said strap is continuously affixed along the upper faces of the panels except at the handles.

4. The flotation device of claim 1, further comprising a third flat buoyant panel having opposing outward ends, a width between side edges, and upper and lower faces, said third panel pivotally connected at its outward ends between the inward ends of said first and second panels at first and second transverse hinges, for pivotal movement of the first, second and third panels from a substantially flat, coplanar configuration to a substantially U-shaped configuration.

5. The flotation device of claim 4, wherein said third panel has a uniform thickness equal to the thickness of the first and second panels.

6. The flotation device of claim 5, wherein the thickness of the third panel along its outward ends is beveled to form wedges, the apexes of the wedges connected to the inward ends of the first and second panels to form the transverse hinges.

7. The flotation device of claim 4, wherein said third panel is generally rectangular in plan view, with a width equal to the width of the inward ends of the first and second panels.

8. The flotation device of claim 1, wherein said first and second panels are entirely covered with a fabric material and said pivotal connection is formed by a line of stitching connecting layers of the cover between the panels.

9. The flotation device of claim 4, wherein said first, second and third panels are entirely covered with a fabric material and said transverse pivotal hinges are formed by lines of stitching connecting layers of the cover between the panels.

10. A multipurpose flotation device, comprising:

a first flat buoyant panel having inward and outward ends, a width between side edges, and upper and lower faces;

a second flat buoyant panel having inward and outward ends, a width between side edges, and upper and lower faces;

a third flat buoyant panel having opposing outward ends, a width between side edges, and upper and lower faces;

said third panel having a width less than the width of the first and second panels;

said first panel inward end pivotally connected to one outward end of the third panel alone a first transverse hinge;

said second panel inward end pivotally connected to the other outward end of the third panel alone a second transverse hinge;

said hinges providing pivotal movement of the first and second panels about the outward ends of the third panel from a substantially flat, coplanar configuration to a substantially U-shaped configuration; and wherein each of said first and second panels has a narrowed width at the inward end terminating in a width equal to the width of the third panel.

11. The flotation device of claim 10, further comprising a strap mounted on the upper faces of said first, second and third panels with loops at opposing ends forming a handle projecting beyond the outward ends of the first and second panels.

12. The flotation device of claim 10, wherein:

the thickness of each of the first and second panels along their inward ends is beveled to form a wedge;

the thickness of the third panel along its outward ends is beveled to form wedges;

the apexes of adjacent wedges between the third panel and the first and second panels are connected to form the transverse hinges.

13. The flotation device of claim 10, wherein said first, second and third panels are entirely covered with a fabric material and said transverse pivotal hinges are formed by lines of stitching connecting layers of the cover between the panels.

14. The flotation device of claim 10, wherein said panels have a uniform thickness.

* * * * *